United States Patent [19]

Eckel et al.

[11] 4,117,783

[45] Oct. 3, 1978

[54] MODULAR STORAGE UNIT

[75] Inventors: Leonard B. Eckel, Helena, Mont.; James P. Sullivan, Tustin; Elias D. Quintana, Huntington Beach, both of Calif.

[73] Assignee: Design West Incorporated, Irvine, Calif.

[21] Appl. No.: 856,857

[22] Filed: Dec. 2, 1977

[51] Int. Cl.[2] ..... A47B 45/00

[52] U.S. Cl. ..... 108/91; 108/111; 211/194

[58] Field of Search ..... 108/111, 91, 53.5, 114, 108/101; 211/188, 194, 182; 182/178

[56] References Cited

U.S. PATENT DOCUMENTS

| | | | |
|---|---|---|---|
| 2,600,191 | 6/1952 | Beach | 211/194 |
| 2,836,304 | 5/1958 | Furrer | 211/194 X |
| 2,916,239 | 12/1959 | Stopps | 108/53.5 X |
| 3,747,965 | 7/1973 | Wing | 108/111 |

FOREIGN PATENT DOCUMENTS

| | | | |
|---|---|---|---|
| 1,093,296 | 11/1967 | United Kingdom | 211/188 |

*Primary Examiner*—Francis K. Zugel
*Attorney, Agent, or Firm*—George J. Netter

[57] ABSTRACT

The present invention pertains to storage units for use in the home, factory, office or the like, and, more particularly, to such storage units constructed of module units which can be assembled together into a variety of forms or shapes, for accommodating room contours or producing an esthetically pleasing appearance.

4 Claims, 8 Drawing Figures

FIG. 4.
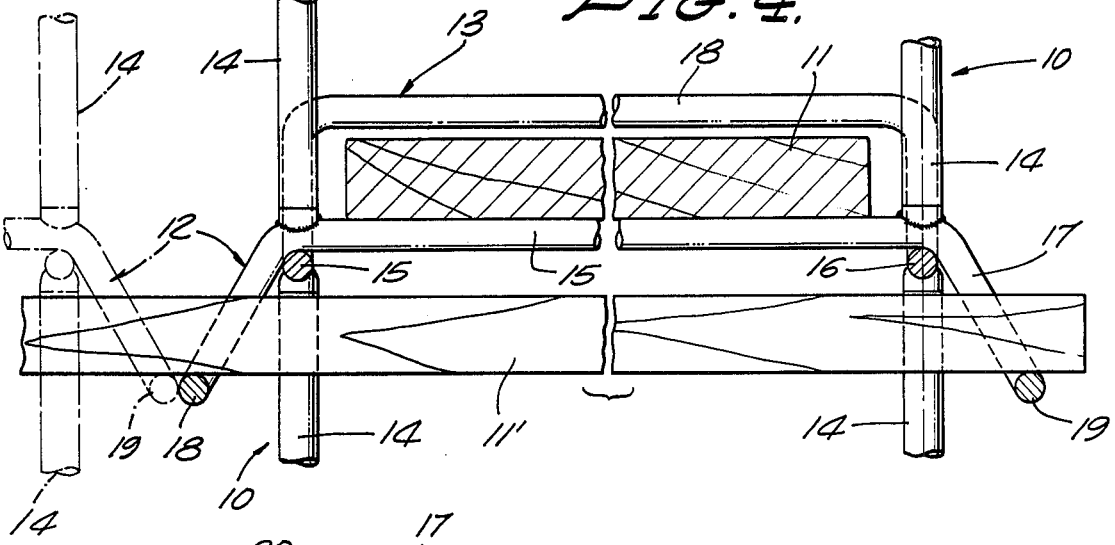
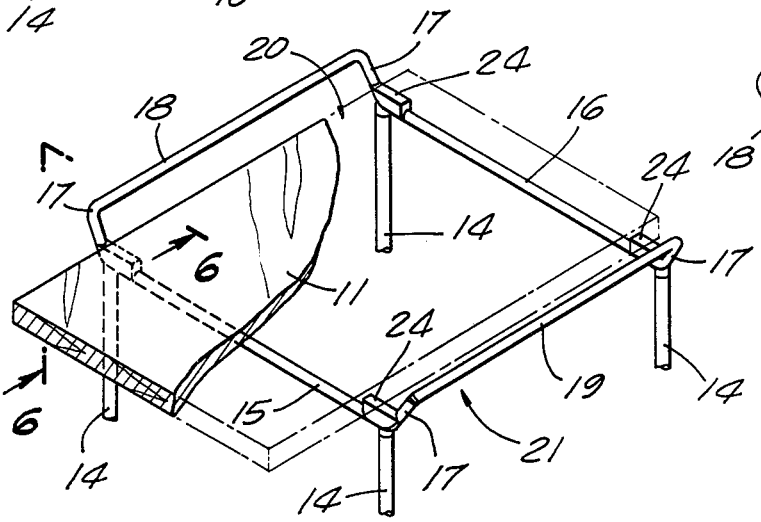
FIG. 5.
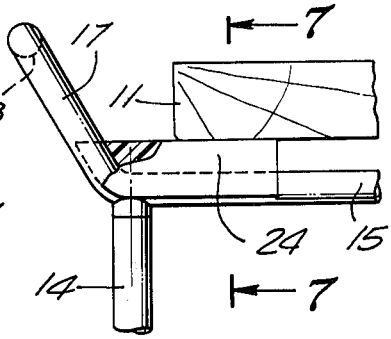
FIG. 6.
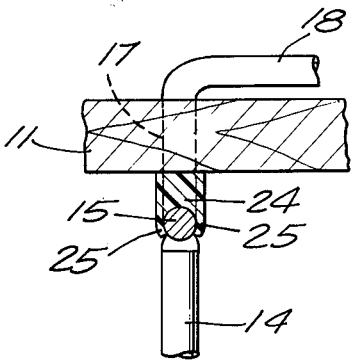
FIG. 7.
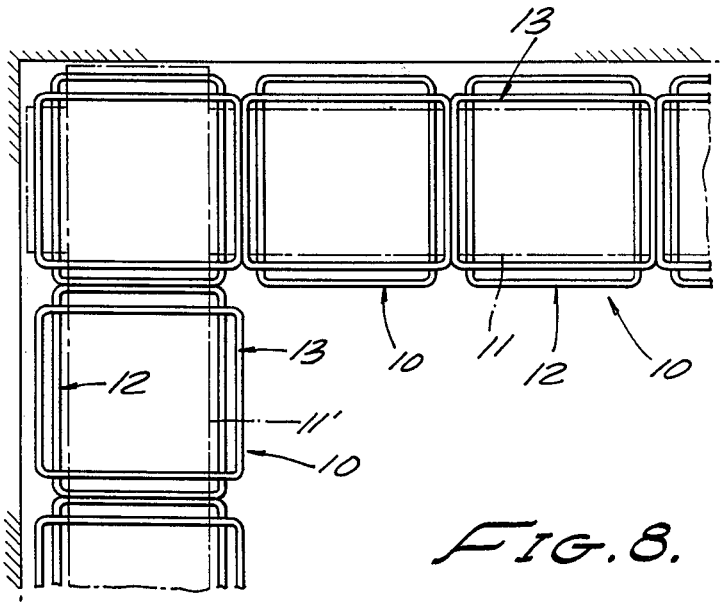
FIG. 8.

MODULAR STORAGE UNIT

BACKGROUND OF THE INVENTION

It is conventional to store such things as books, phonograph records, and other such items in cabinets that are of predetermined shape and size and having internal shelves in fixed arrangement. The typical book case, for example, consists of a variety of parallel, horizontal shelves with the bookcase having a fixed construction so that if, for example, it were to be moved to another room, it might be found to be either too large or not have other dimensional aspects making it suitable for use in the new location.

There are known modular approaches to providing storage units in which a plurality of members are originally provided broken-down or in kit form and assembled at the site to a given arrangement. These have consisted of modular parts which are fixedly arranged together at the site of use. It is this general type of modular unit to which the present invention pertains and has an improved construction such that it may be easily packed into shipping containers at the place of manufacture and which on removal at the point of use is easily and readily assembled into the desired modular construction.

SUMMARY OF THE INVENTION

In the practice of this invention a plurality of modules are provided, each having a tube-like frame with open sides, front, bottom and top, the various component frame parts being fitted together by open ends of corner tubes being received onto accommodating studs of others. The frame parts of the modules are so arranged when a plurality of modules are interrelated as to provide slots through which shelving may be received and supported. The modules may be assembled vertically or horizontally together to form the desired storage unit.

DESCRIPTION OF THE DRAWING

FIG. 4 is a sectional, elevational view taken along line 4—4 of FIG. 3, particularly showing shelving in place in the modular unit.

FIG. 5 is a perspective view of a modified form of the module having a modified form of panel supporting the unit.

FIG. 6 is a side elevational, sectional view, taken along line 6—6 of FIG. 5, showing the modified panel support of FIG. 5.

FIG. 7 is a further elevational, sectional view taken along line 7—7 of FIG. 6.

FIG. 8 is a plan view of one type of arrangement of the modular units of this invention.

DESCRIPTION OF A PREFERRED EMBODIMENT

Figure 1:
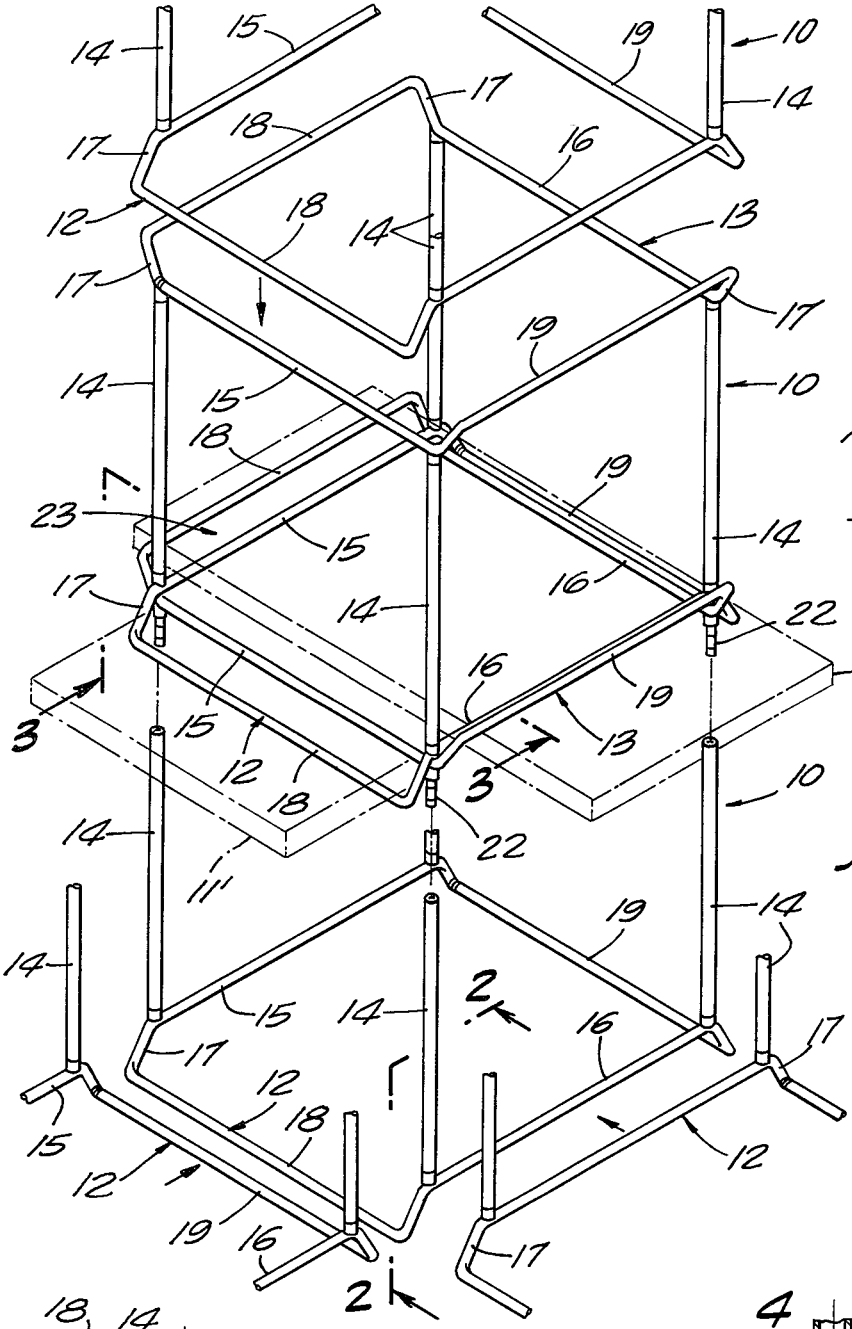
FIG. 1 is a perspective, partially fragmentary view of a plurality of modules constructed in accordance with this invention and related to one another, forming a storage unit.

Turning now to the drawings, and particularly FIG. 1, it is seen that the storage and shelving construction of this invention consists of a plurality of generally parallelepiped modules 10, which can be assembled to one another to form an integral storage unit frame.

Shelving as at 11 can be slid horizontally through accommodating slots formed by coaction of adjacent module parts, which shelving is thereby temporarily secured within the overall construction to serve as support for articles to be stored, and to provide rigidity to the storage unit.

Each of the modules 10 includes a pair of identical generally rectangular frames 12 and 13, maintained in spaced vertically separated relation by four corner members 14. More particularly, each of the corner spacers 14 consists of a hollow cylindrical tube, both ends of which are open for receipt onto accommodating studs of the frames 12 and 13 to be described.

Each of the frames 12 and 13 is constructed of a rodlike material which is shaped into a closed rectangular path, the frame material having a diameter substantially the same as that of the tubular spacers 14. In particular, the frames 12 and 13 include a pair of parallel side elements 15 and 16, lying in a first plane and having at their end portions slanting or sloped elements 17 which interconnect with parallel side elements 18 and 19. The parallel side elements 18 and 19 lie in a plane parallel to that of the first parallel elements 15 and 16, and spaced therefrom. By this construction, each of the frames has a generally concave major side 20 (FIG. 5), including the elements 18 and 19, and slanting elements 17 and and a convex major side 21.

On the convex side 21 of each frame at each of the corners defined by the junction of parallel side elements 15–16, and the slanting elements 17, there is provided a relatively short stud or stanchion 22, affixed to the frame and extending outwardly on the convex side 21 at right angles to both sets of parallel elements 15–16 and 18–19.

Figure 2:
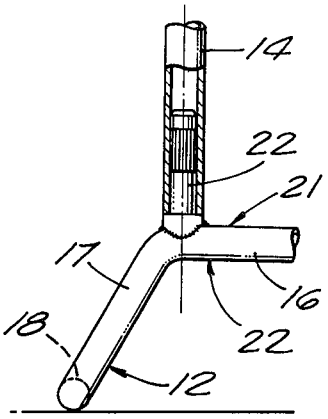
FIG. 2 is a side elevational, sectional view taken along the line 2—2 of FIG. 1, showing a module corner construction in detail.
Figure 3:
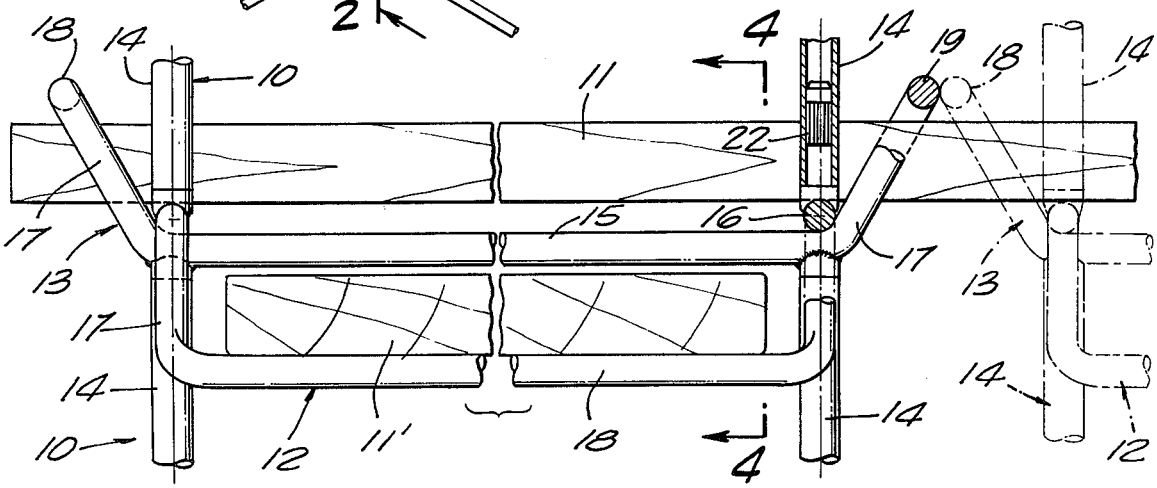
FIG. 3 is a further side elevational, sectional view taken along line 3—3 of FIG. 1.

In assembly of each module 10, a pair of frames 12–13 are held in spaced relation with their convex sides facing each other and interconnected by four corner tubular spacers 14, the ends of the spacers being received onto the studs 22 (FIGS. 2 and 3). An assembled module has the appearance of a parallelepiped as seen best in FIG. 1 with the top being concave upwardly and the bottom concave downwardly.

A plurality of assembled modules 10 can then be vertically stacked onto one another by merely resting the parallel side elements 15–16 of one module on the corresponding elements 15–16 of another module when the two modules are arranged at 90° to one another. Thus, when, as shown in FIG. 1, the upper module is lowered down onto the module immediately below it, as shown by the arrow, the elements 18–19 of the immediately adjacent modules extend at 90° to each other. It is to be noted than when a pair of modules 10 are vertically mounted one on the other, as in FIG. 1, a space is provided between the side elements 18 and 19 of one of the modules and the elements 15 and 16 of the other module, which space is identified by the numeral 23. This permits typical rectangular shelving 11 to be slid through the spaces 23, providing a support surface and also acting to lock the adjacent modules together. Thus, with the shelving in place, any attempt to lift the upper module from the lower is resisted by the shelving.

In addition to vertical stacking of modules, as discussed in the preceding paragraph, modules may be located immediately adjacent one another in a horizontal direction with sides 18 and 19 contacting the same sides of the adjacent module. In this case, the shelving, on passing through a plurality of spaces 23 of modules arranged in horizontal juxtaposition, relates them together as a storage unit.

Again in reference to FIG. 1, in addition to horizontal arrangements of modules in one direction, further horizontal arrangements may be made from the same module at 90° to the first direction. For example, as shown there, a second shelving member 11' may be located immediately below the first shelving 11 and at 90° thereto, for accommodating and securing further modules along that new direction.

In addition to the embodiment already described, a modified version, as shown in FIGS. 5, 6 and 7, includes rests 24 secured to the sides 15–16 on the concave side at the junction with the slanting members 17. Each of the rests has a flat upper surface, all four of the upper surfaces for any one frame lying in the same plane. In use, shelving 11 and 11' may be more easily accommodated and held in a more consistent planar arrangements by virtue of the common plane formed by the upper surface of the supporting rests. In detail, each rest has a pair of extending walls 25 defining a cavity therebetween which can be received down onto and about the frame side elements 15 and 16 with securement being achieved by crimping the walls 25 about the frame elements (FIG. 7).

Although some variations in materials used to construct the module frames and spacers may exist and still be within the spirit of this invention, it is preferred that the frames be made of either solid cylindrical rod metal materials or hollow cylindrical metal tubing. In this case, after appropriate forming, the ends may be butt welded together, and the studs or stanchions similarly welded in place. Hollow metal tubular spacers are also preferred. Alternatively, the various module parts may be molded from a suitable plastic.

It is further contemplated that in shipment, storage and inventory, the modules will be packaged in broken down condition along with a certain number of shelves, the final assembly being left to the ultimate purchaser.

We claim

1. A storage unit in which a plurality of frame modules are interrelated to form an integral structure and include shelving members slidingly interconnecting the modules providing supportive storage, comprising:

each module including, upper and lower open frames of identical generally rectangular configuration, having a first pair of parallel sides lying in one plane, a second pair of parallel sides lying in a second plane spaced from and parallel to the first plane, and slanting members interconnecting the ends of first parallel sides to the ends of the second parallel sides, studlike means affixed to each frame adjacent the junction of the slanting members and the respective first parallel sides, said studlike means all extending in the same direction, and a plurality of spacers, each spacer having first and second ends with openings therein;

said spacer openings being received onto the studlike means of the upper and lower frames, thereby holding the two frames in a fixed predetermined configuration.

2. A storage unit as in claim 1, in which said upper and lower frames are constructed of rodlike metal, and said spacers of hollow cylindrical tubing.

3. A storage unit as in claim 1, in which the upper and lower frames have the first pairs of parallel sides of each arranged parallel to each other, and the slanting members of the upper frame extends oppositely away from the lower frame.

4. A storage unit as in claim 2, in which there are further provided means clampingly secured to the frames forming a plane surface on which shelving members rest.

* * * * *